US008934817B2

(12) United States Patent
Matsumoto

(10) Patent No.: US 8,934,817 B2
(45) Date of Patent: Jan. 13, 2015

(54) DEVELOPING DEVICE AND IMAGE FORMING APPARATUS

(71) Applicant: Canon Kabushiki Kaisha, Tokyo (JP)

(72) Inventor: Atsushi Matsumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 13/826,277

(22) Filed: Mar. 14, 2013

(65) Prior Publication Data

US 2013/0287449 A1 Oct. 31, 2013

(30) Foreign Application Priority Data

Apr. 27, 2012 (JP) ..... 2012-102578

(51) Int. Cl.
*G03G 15/08* (2006.01)
*G03G 15/09* (2006.01)

(52) U.S. Cl.
CPC .... *G03G 15/0812* (2013.01); *G03G 2215/0822* (2013.01); *G03G 15/09* (2013.01)
USPC ..... 399/272; 399/254; 399/274; 399/277

(58) Field of Classification Search
CPC ..... G03G 15/081; G03G 2215/0802; G03G 2215/0822
USPC ..... 399/272, 274, 277, 254, 256
See application file for complete search history.

(56) References Cited

U.S. PATENT DOCUMENTS 4,940,014 A * 7/1990 Saijo et al. ..... 399/256
6,259,876 B1 * 7/2001 Fukuda et al. ..... 399/254
7,826,775 B2 11/2010 Nakayama et al.
2008/0247786 A1 10/2008 Nakayama et al.
2012/0051793 A1 * 3/2012 Kudo et al. ..... 399/254
2012/0207492 A1 * 8/2012 Fujiwara et al. ..... 399/254 X
2012/0251185 A1 10/2012 Matsumoto
2012/0269555 A1 10/2012 Matsumoto et al.
2013/0045029 A1 * 2/2013 Kimura et al. ..... 399/272

FOREIGN PATENT DOCUMENTS

JP 5-333691 A 12/1993
JP 3104722 B2 10/2000
JP 2008-256813 A 10/2008
JP 2011-85881 A 4/2011
JP 5039416 B2 10/2012

* cited by examiner

*Primary Examiner* — Sophia S Chen
(74) *Attorney, Agent, or Firm* — Fitzpatrick, Cella, Harper & Scinto

(57) ABSTRACT

A developing device includes a developer carrier which carries a developer containing a toner and a carrier, and a developing chamber which feeds the developer to the developer carrier. In addition, a conveying member conveys the developer of the developing chamber, and a regulating member regulates an amount of the developer coated on the developer carrier. A guide portion guides the developer to the developer carrier and forms a buffer portion that temporarily contains the developer fed from the developing chamber between the regulating member and the guide portion. The guide portion has a facing surface opposing the developer carrier along a front surface of the developer carrier and a guiding surface which guides the developer from an upper edge of the guide portion to a downstream side of the facing surface in a rotational direction of the developer carrier. Magnetic poles inside the developer carrier are disposed so that a magnetic direction effecting the carrier in the developer on the guiding surface is set in a direction to leave the guiding surface in a range from an upper portion toward a lower portion of the guiding surface.

8 Claims, 27 Drawing Sheets

*FIG. 11*

Expression (1)

$$\vec{F}m = \frac{\mu - \mu_0}{\mu_0(\mu + 2\mu_0)} 2\pi b^3 \nabla B^2$$

$\mu_0$ is magnetic permeability of vacuum;

$\mu$ is magnetic permeability of magnetic carrier;

b is radius of magnetic carrier;

B is magnetic flux density.

Expression (2)

$$\vec{F}m \propto \nabla B^2$$

$$= \frac{\partial}{\partial r}\left(Br^2 + B\theta^2\right)\vec{e}_r + \frac{1}{r}\frac{\partial}{\partial\theta\left(B_r^{\ 2} + B_\theta^{\ 2}\right)}\vec{e}_\theta$$

$$\therefore \vec{F}m \propto \left(B_r \frac{\partial B_r}{\partial r} + B_\theta \frac{\partial B_\theta}{\partial r}\right)\vec{e}_r + \frac{1}{r}\left(B_r \frac{\partial B_r}{\partial \theta} + B_\theta \frac{\partial B_\theta}{\partial \theta}\right)\vec{e}_\theta$$

Expression (3)

$$A_z(R,\theta) = \int_0^\theta RBrd\theta$$

Expression (4)

$$\nabla^2 A_z(r,\theta) = 0$$

Expression (5)

$$B_\theta = -\frac{\partial A_z(r,\theta)}{\partial r}$$

*FIG. 13*

| $\alpha$ | EXTENT TO WHICH DEVELOPER STICKS TO GUIDE MEMBER |
|---|---|
| 60 | ○ |
| 45 | ○ |
| 40 | △ |
| 30 | △ |
| 20 | × |

*FIG. 19*

| | EXTENT TO WHICH DEVELOPER STICKS TO GUIDE MEMBER |
|---|---|
| PRESENT EMBODIMENT | ○ |
| COMPARATIVE EXAMPLE : $\alpha = 20°$ | × |

*FIG. 26*

| | EXTENT TO WHICH DEVELOPER STICKS TO GUIDE MEMBER |
|---|---|
| PRESENT EMBODIMENT | ○ |
| $\alpha = 30°$ | × |

DEVELOPING DEVICE AND IMAGE FORMING APPARATUS

BACKGROUND OF THE INVENTION

1. Field of the Invention

The present invention relates to a developing device that forms an image using an electrophotographic system, and an image forming apparatus having the same.

2. Description of the Related Art

Conventionally, developing devices include those that use a two-component developer having non-magnetic toner particles (toner) and magnetic carrier particles (carrier) as a developer. For example, in Japanese Patent Laid-Open No. 05-333691, the developing device using the two-component developer is generally configured as illustrated in FIG. 27. FIG. 27 is an explanatory view of a conventional developing device.

A conventional developing device 101 is equipped with a developing container 102 containing the developer, and has a developing sleeve 108 that is a developer carrier at an opening facing a photosensitive drum (not illustrated) that is an image bearing member. Thus, a developing chamber 103 and an agitating chamber 104 into which the developing container 102 is partitioned with a partition 107 are vertically formed in the developing container 102 at an opposite side of the opening. A conveying screw 105 and a conveying screw 106 are disposed in the developing chamber 103 and the agitating chamber 104, respectively. Through operations of the conveying screw 105 and the conveying screw 106, a developer and a toner in the developing chamber 103 and the agitating chamber 104 are agitated and conveyed, and a toner density in the developer is made uniform.

Further, a regulating blade 109 is disposed above the developing sleeve 108 as a layer thickness regulating member. The developer is uniformly coated on the developing sleeve 108 by the regulating blade 109, and is conveyed up to a developing region. A gap between the developing sleeve 108 and the regulating blade 109 is adjusted so that the developer is fed to the developing region in a uniform and steady way.

Here, to cause the developer to be more steadily fed to the developing region, the developer needs to be steadily fed to an upstream side of the regulating blade 109 based on a rotational direction of the developing sleeve 108. Accordingly, the inventors examined providing a guide member for securing the developer at a tip 107*a* of the partition 107 which is located at a side of the developing sleeve 108 and at a more upstream side than the regulating blade 109 based on the rotational direction of the developing sleeve 108.

However, if the guide member for securing the developer is provided at the upstream side of the regulating blade 109 based on the rotational direction of the developing sleeve 108, the developer may stick to a surface of the guide member, and the coating on the developing sleeve 108 may be made unsteady. This phenomenon tends to take place particularly when the developer is deteriorated.

The deterioration of the developer means that, due to a collision between the toner and the developing sleeve or between the toners, the toner and particularly a convex part of the toner is damaged, or an external additive on a toner surface is buried in the toner surface.

When the deterioration of the developer occurs, the external additive such as silica added to improve fluidity of the toner is buried in the toner surface. Thereby, an adhesive force of the toner is increased, and the fluidity is reduced. This developer deterioration is prone to take place mainly when an image with a low consumption of the toner continues to be output for a long time, because the developer is agitated inside the developing device for a long time.

Thus, if this developer deterioration takes place, the adhesive force of the toner is increased. As such, the friction against the surface of the guide member makes it easier for the developer to adhere. In this way, when the guide member and the developer adhere to each other, a region between the regulating blade 109 and the guide member is narrowed, and the developer cannot be steadily fed to a nap cutting portion of the regulating blade 109. As a result, problems such as the coating on the developing sleeve 108 failing to be uniform occur.

To solve the above problems, a configuration in which a distance between the regulating blade 109 and the guide member is increased is also taken into consideration. That is, a configuration in which an installed position of the guide member is set to be a more upstream side with respect to of the regulating blade 109 based on the rotational direction of the developing sleeve 108 is also taken into consideration.

However, as a distance between a lower end of the guide member and the regulating blade 109 is increased, the developer receiving an external force from the developing sleeve 108 is increased, and the developer deterioration is accelerated. For this reason, the lower end of the guide member approaches the side of the regulating blade 109. Therefore, the top of the guide member needs to be kept away from the regulating blade 109. Then, the guide member should be installed at a certain angle but not in a vertical direction.

SUMMARY OF THE INVENTION

The present invention is directed to suppress attachment of a developer to a surface of a guide member and reduce unsteadiness of a coat caused by poor feeding of the developer.

According to an aspect of the present invention, there is provided a developing device, which includes: a developer carrier carrying a developer containing a toner and a carrier; a magnet installed inside the developer carrier and including a plurality of magnetic poles in a rotational direction of the developer carrier; a developing chamber feeding the developer to the developer carrier; a conveying member conveying the developer of the developing chamber; a regulating member regulating an amount of the developer coated on the developer carrier; and a backup portion forming a side of the developing chamber between the regulating member and the conveying member and forming a buffer portion that temporarily contains the developer fed from the developing chamber between the regulating member and the backup portion, wherein the backup portion includes a guide portion inclined downward from the top in order to guide the developer from a top of the backup portion to a position facing the developer carrier, and the plurality of magnetic poles is installed so that a direction of a magnetic force acting on the carrier above the guide portion becomes a direction in which the carrier is separated from a surface of the guide portion.

Further features of the present invention will become apparent from the following description of exemplary embodiments with reference to the attached drawings.

BRIEF DESCRIPTION OF THE DRAWINGS

FIG. 11 is a diagram illustrating numerical expressions used when obtaining a magnetic flux density of the first embodiment;

FIG. 13 is a diagram illustrating test results of the first embodiment;

FIG. 19 is a diagram illustrating test results of the second embodiment;

FIG. 26 is a diagram illustrating test results of the third embodiment; and

DESCRIPTION OF THE EMBODIMENTS

Hereinafter, embodiments of a developing device and an image forming apparatus according to the present invention will be described with reference to the appended drawings. Note that the developing device is used in, for instance, the image forming apparatus to be described below, but the present invention is not essentially limited to this example.

First Embodiment

Figure 1:
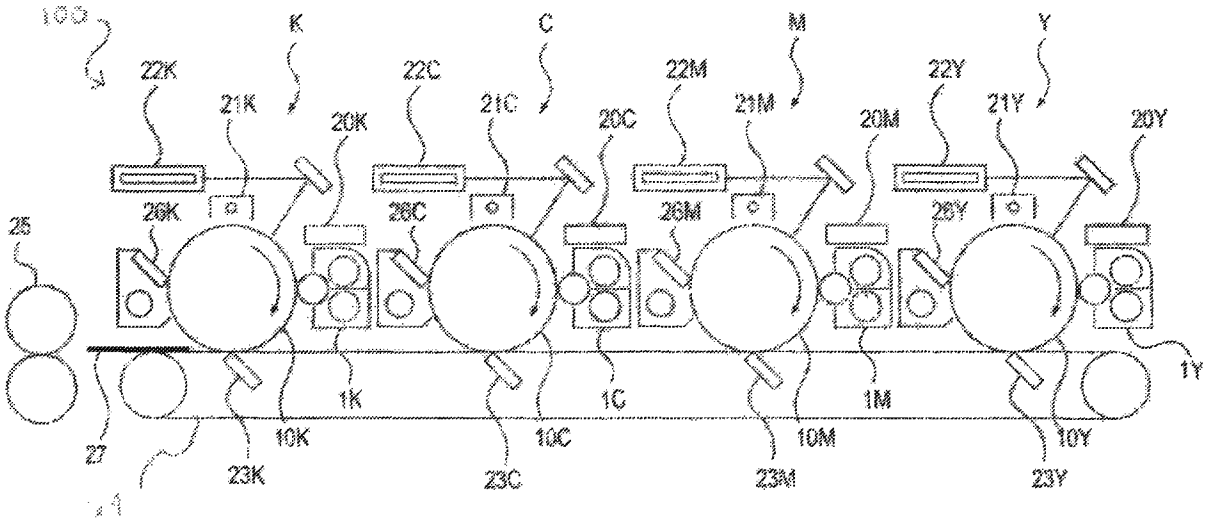
FIG. 1 is a view for describing a positional relation between an image forming apparatus and a developing device of a first embodiment.

<Image Forming Apparatus> FIG. 1 is a view for describing a positional relation between an image forming apparatus and a developing device of a first embodiment. In the image forming apparatus 100, a positional relation between a photosensitive drum (image bearing member) 10 and a developing device (developing portion) 1 at each one of Y, M, C, and K stations is illustrated in FIG. 1.

The Y, M, C, and K stations have substantially the same configuration, and form yellow (Y), magenta (M), cyan (C), and black (K) images in a full-color image, respectively. In the following description, for example, the developing device 1 will commonly indicate a developing device 1Y, a developing device 1M, a developing device 1C, and a developing device 1K at the respective Y, M, C, and K stations.

First, an operation of the entire image forming apparatus will be described based on FIG. 1. A photosensitive drum 10 is installed so as to be freely rotatable. The photosensitive drum 10 is uniformly charged by a primary charger 21. Next, light such as laser light, which is modulated in response to an information signal, is exposed by an exposure device 22, thereby forming an electrostatic latent image on the photosensitive drum 10.

The electrostatic latent image is converted into a visible image as a developed image (toner image) in processes to be described below by the developing device 1. The toner image is transferred onto a transferring material 27, which is a recording material conveyed by a transferring material conveying belt 24, at each station by a primary transfer charger 23, and then is fixed by a fixing device 25. Thereby, a permanent image is obtained.

Further, a remaining transfer toner on the photosensitive drum 10 is removed by a cleaning device 26. The toner of the developer consumed by image formation is replenished from a toner replenishment tank 20. Here, the method of directly transferring the image from the (Y, M, C, and K) photosensitive drums 10 to the transferring material 27 that is the recording material conveyed by the transferring material conveying belt 24 is employed. However, the present invention is not limited to this method. For example, a method of providing an intermediate transfer member in place of the transferring material conveying belt 24, primarily transferring toner images of respective colors from the (Y, M, C, and K) photosensitive drums 10 to the intermediate transfer member, and then secondarily transferring combined toner images of the respective colors to the transferring material all at once may also be applied.

<Description of Binary Developer> Next, a two-component developer used in the present embodiment will be described.

The toner includes colored resin particles containing a binder resin, a colorant, and other additives as needed, and colored particles to which an external additive such as colloidal silica fine powder is externally added. Thus, the toner is a polyester-based resin of negative chargeability. In the present embodiment, the toner having a volume average particle diameter of 7.0 μm is used. An average particle diameter of the toner may range from 2 μm to 10 μm, and preferably from 4 μm to 8 μm.

Further, for a carrier, for instance, surface-oxidized or -unoxidized iron, nickel, cobalt, manganese, chromium, a metal such as a rare earth metal, and an alloy thereof, or oxide ferrite may be adequately used, and a method of manufacturing magnetic particles of these is not particularly restricted. In the present embodiment, the carrier having a volume average particle diameter of 40 μm, resistivity of $5\times10^8$ Ωcm, and an amount of magnetization of 260 emu/cc is used. An average particle diameter of the carrier may range from 20 μm to 80 μm, and preferably from 30 μm to 60 μm. Further, the amount of magnetization may range from 100 emu/cc to 400 emu/cc, and preferably from 200 emu/cc to 300 emu/cc.

In the present embodiment, a mixture in which the toner and the carrier are mixed at a ratio of 8:92 based on the percent by weight is used as the developer. A mixing ratio of the toner to the carrier may range, based on the percent by weight, from 4% to 14%, and preferably from 6% to 10%.

<Measuring Method> With respect to the toner used in the present embodiment, the volume average particle diameter thereof was measured by the following device and method.

As a measuring device, Coulter counter-TA-II type (commercially available from Coulter Inc.), an interface (commercially available from Nikkaki) for outputting number average distribution and volume average distribution, and HP Compaq dc7100 were used. Further, as an electric field aqueous solution, 1% NaCl aqueous solution prepared using primary sodium chloride was used.

A measuring method is as follows. In detail, 0.1 ml of surfactant, preferably alkyl benzene sulfonate, is added as dispersant to 100 to 150 ml of the electric field aqueous solution, and a measurement sample of 0.5 to 50 mg is added.

The electric field aqueous solution suspending the sample is dispersed for about 1 to 3 minutes by an ultrasonic dispersion device. Particle size distribution of particles of 2 to 40 μm using an aperture of 100 μm as an aperture is measured by the Coulter counter-TA-II type, thereby obtaining the volume average distribution. The volume average particle diameter is obtained from the volume average distribution obtained in this way.

Further, using a sandwich type cell having a measuring electrode area of 4 cm and an inter-electrode spacing of 0.4 cm, the resistivity of the magnetic carrier used in the present embodiment was measured from current flowing to a circuit by applying applied voltage E (V/cm) between both electrodes under application of weight of 1 kg to one electrode by a method of obtaining the resistivity of the carrier. Further, the volume average particle diameter of the magnetic particle is measured by putting a range of the particle diameter of 0.5 to 350 μm to 32 logarithmic division based on a volume using a laser diffraction type particle size distribution measuring device HEROS (commercially available form JEOL). Then, the number of particles is measured in each channel. From a result of the measurement, a median diameter of 50% volume is used as the volume average particle diameter.

Further, magnetic properties of the magnetic carrier used in the present embodiment were measured using a vibration magnetic field magnetic property automatic recording device BHV-30 commercially available from Riken Denshi Co. Ltd. A magnetic property value of the carrier powder was determined by producing external magnetic fields of 795.7 kA/m and 79.58 kA/m, and obtaining the intensity of magnetization of the magnetic carrier. A measuring sample of the magnetic carrier is produced in a packed state so as to be sufficiently dense in a cylindrical plastic container.

In this state, magnetizing moment is measured, and actual weight of the filled sample is measured to obtain the intensity of magnetization (emu/g). Further, true specific gravity of the magnetic carrier particle is obtained by, for instance, a dry automatic densimeter Acupic 1330 (commercially available from Shimadzu Co. Ltd.). The intensity of magnetization obtained through the foregoing is multiplied by the true specific gravity. Thereby, the intensity of magnetization per unit volume can be obtained.

Figure 2:
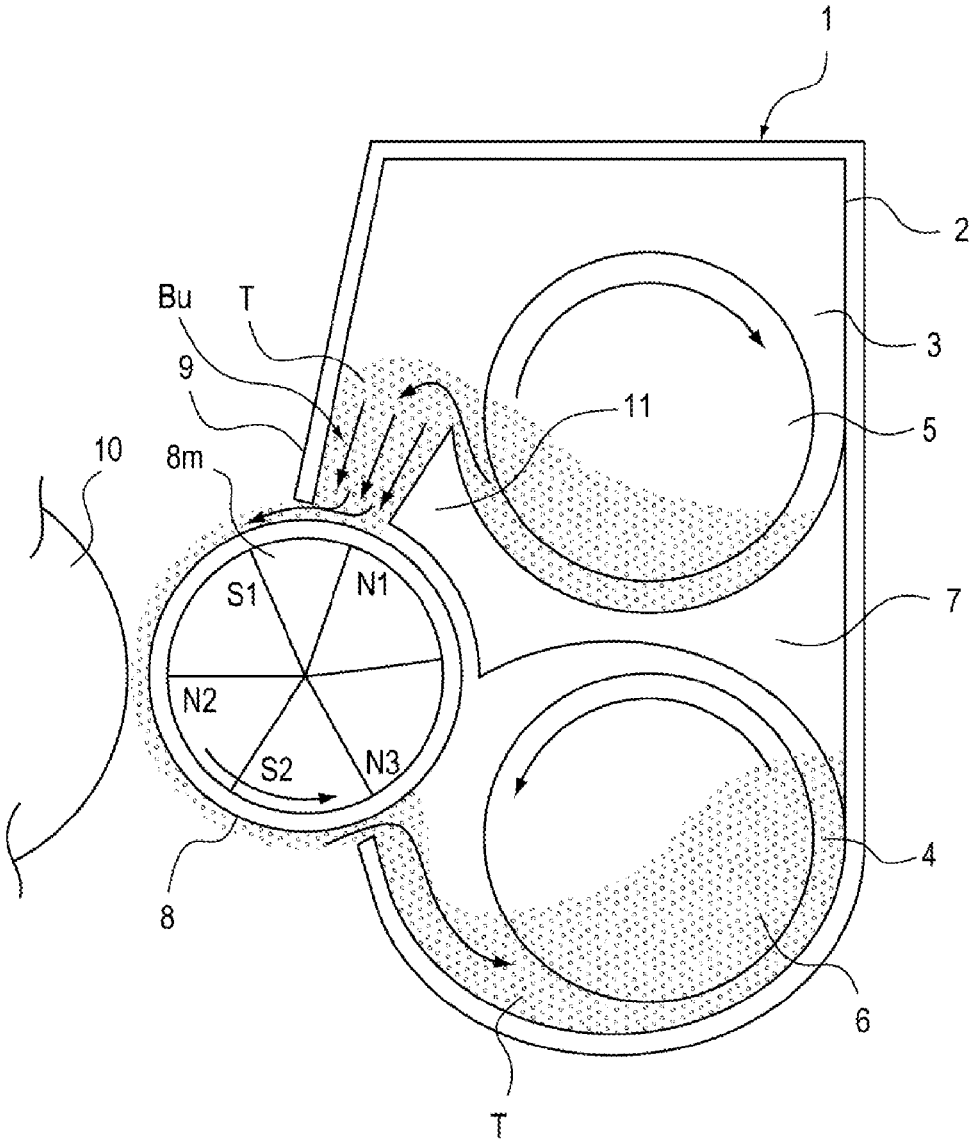
FIG. 2 is a view for describing the developing device of the first embodiment.

<Developing Device> Next, a configuration and operation of the developing device 1 will be described using FIGS. 2 and 3. FIG. 2 is a view for describing the developing device of the first embodiment, and FIG. 3 is a cross-sectional view for describing developing and agitating chambers of the developing device of the first embodiment.

Figure 3:
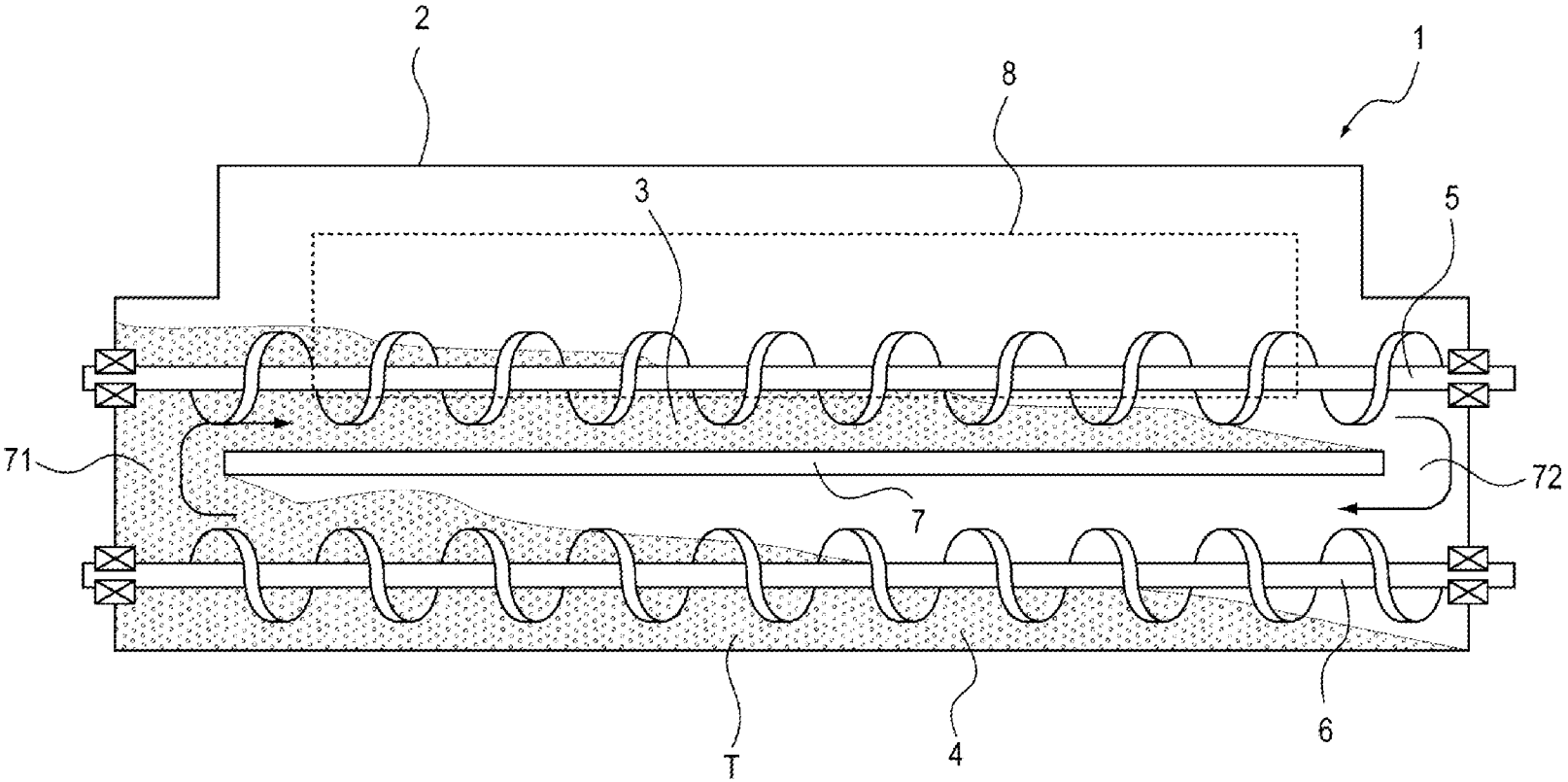
FIG. 3 is a cross-sectional view for describing a developing chamber and an agitating chamber of the developing device of the first embodiment.

As illustrated in FIGS. 2 and 3, the developing device 1 has a developing container 2. A two-component developer including a non-magnetic toner and a magnetic carrier is contained in the developing container 2. The developing container 2 is provided therein with a developing sleeve (developer carrier) 8, and a regulating blade (layer thickness regulating member) 9 that is installed so as to face the developing sleeve 8 and regulates a layer thickness of the developer carried on a surface of the developing sleeve 8. The regulating blade 9 is formed of a non-magnetic material.

The developing container 2 is vertically partitioned into developing chamber 3 and an agitating chamber 4 with a partition 7 extending at approximately an inner middle portion thereof in a direction perpendicular to the plane of sheet. The developer is contained in the developing chamber 3 and the agitating chamber 4.

A first conveying screw 5 (developer feeding member) and a second conveying screw 6 (developer agitating member) which are circulating members that agitate and convey the developer T and cause the developer to circulate in the developing container 2 are disposed in the developing chamber 3 and the agitating chamber 4, respectively. In the present embodiment, the first conveying screw 5 is used as a screw structure in which an agitating blade formed of a non-magnetic material is installed around a rotational shaft formed of a non-magnetic material in a spiral shape. Further, like the first conveying screw 5, the second conveying screw 6 is also used as a screw structure in which an agitating blade is installed around a rotational shaft in a spiral shape in an opposite direction of the first conveying screw 5.

The first conveying screw 5 is disposed above the bottom of the developing chamber 3 almost in parallel with the axial direction of the developing sleeve 8, and rotates to convey the developer T in the developing chamber 3 in the axial direction. The second conveying screw 6 is disposed above the bottom of the agitating chamber 4 almost in parallel with the first conveying screw 5, and conveys the developer T in the agitating chamber 4 in the opposite direction of the first conveying screw 5.

In this way, the developer T is conveyed by the rotation of the first and second conveying screws 5 and 6. Here, distribution of the developer T in the developing device 1 circulates between the developing chamber 3 and the agitating chamber 4 through communicating parts 71 and 72 illustrated in FIG. 3.

Furthermore, an opening is present at a position corresponding to a developing region facing the photosensitive drum 10 of the developing container 2. The developing sleeve 8 is rotatably disposed in the opening so as to be partly exposed to a side of the photosensitive drum 10.

The developing sleeve 8 is formed of a non-magnetic material such as aluminum or stainless steel. A magnet roller (magnetic field generating member) **8*m* is mounted in the developing sleeve 8 in a non-rotating state. The magnet roller 8*m* includes a developing pole N2 and a plurality of magnetic poles S1, N1, S2, and N3 conveying the developer. Among them, a first magnetic pole N3 and a second magnetic pole N1, both of which are the same poles, are disposed adjacent to each other and inside the developing container 2, form a repulsive magnetic field therebeteween, form a barrier against the developer T, and are configured to separate the developer T in the agitating chamber 4. Thereby, the developer carried on the developing sleeve 8 is recovered in the agitating chamber 4**.

The developing sleeve 8 has a diameter of 20 mm, and the photosensitive drum 10 has a diameter of 80 mm. Further, a closest region between the developing sleeve 8 and the photosensitive drum 10 is set to a distance of about 300 μm. This allows the development to be performed with the developer conveyed to the developing region brought into contact with the photosensitive drum 10.

The developing sleeve 8 rotates in an arrow direction (counterclockwise rotation) of FIG. 2 during development. Thus, in a state in which a magnetic brush (a state in which the developer forms naps on the surface of the developing sleeve 8 like a brush) is formed on the surface of the developing sleeve 8 in front of the developing region, the nap cutting of the magnetic brush is performed by the regulating blade 9. The layer thickness is regulated by the nap cutting. The two-component developer carried on the surface of the developing sleeve 8 is conveyed to the developing region facing the photosensitive drum 10 by rotation of the developing sleeve 8. Then, the developer is fed to an electrostatic latent image formed on the photosensitive drum 10, and thus the electrostatic latent image is developed.

Here, since development efficiency, i.e. an addition rate of the toner to the electrostatic latent image, is improved, development bias voltage in which direct current voltage and alternating current voltage overlap is applied to the developing sleeve 8 from a power supply. In the present embodiment, direct current voltage of −500 V, and alternating current voltage in which peak to peak voltage Vpp is 800 V and a frequency f is 12 kHz are used. However, a value of the direct current voltage and a waveform of the alternating current voltage are not limited to this.

Further, in general, in the development in which the two-component developer forms the magnetic brush, when the alternating current voltage is applied, the development efficiency is increased and the image becomes high in quality. Nevertheless, fog tends to occur. For this reason, by producing a potential difference between the direct current voltage applied to the developing sleeve 8 and a charged potential of the photosensitive drum 10 (i.e., a blank portion potential), the fog is prevented.

In the developing region, the developing sleeve 8 moves in a forward direction together with the direction of movement of the photosensitive drum 10 at a ratio of circumferential velocity of 1.75 times that of the photosensitive drum. The ratio of circumferential velocity is set to a range between 0.5 and 2.5 times, and may be preferably set to a range between 1.0 and 2.0 times. The greater a ratio of moving velocity becomes, the higher the development efficiency becomes. However, if the ratio of moving velocity becomes too great, problems such as toner scattering and developer deterioration are likely to take place. As such, the ratio of moving velocity can be set to the aforementioned range.

Further, the regulating blade 9 is made of a plate-shaped non-magnetic member that extends along a longitudinal axis of the developing sleeve 8 and is formed of aluminum. The regulating blade 9 is disposed at a more upstream side than the photosensitive drum 10 based on the rotational direction of the developing sleeve 8. The regulating blade 9 is disposed at a position at which an extension line thereof passes through the center of the developing sleeve 8 and forms an angle of 65° with respect to the horizontal plane.

Both the toner and the carrier of the developer pass between the tip of the regulating blade 9 and the developing sleeve 8, and are also sent to the developing region. Further, by adjusting a gap between the regulating blade 9 and the surface of the developing sleeve 8, an amount of the nap cutting of the developer magnetic brush carried on the developing sleeve 8 is regulated, and an amount of the developer conveyed to the developing region is adjusted. In the present embodiment, an amount of the developer coat per unit area on the developing sleeve 8 is regulated to 30 mg/cm$^2$ by the regulating blade 9. Further, the gap between the regulating blade 9 and the developing sleeve 8 is set to a range from 200 to 1000 μm, and may be set to a range from 300 to 700 μm. In the present embodiment, the gap is set to 500 μm.

As illustrated in FIG. 2, the guide member 11 is integrally formed with the tip of the partition 7 which is located at a more upstream side than the regulating blade 9 based on the rotational direction of the developing sleeve 8. The guide member 11 is disposed apart from the developing sleeve 8 by a clearance of 1 mm, and steadily secures the developer. The guide member 11 is disposed so as to face the regulating blade 9, and is installed at a position to pass through the center of the developing sleeve 8 and forms an angle of 32.7° with the horizontal plane. With this configuration, by driving of the first conveying screw 5, the developer is fed from an opening between the regulating blade 9 and the guide member 11.

When the horizontal plane is 0°, the angle of the guide member 11 is installed at 45°. A length of the guide member 11 is adjusted to 4 mm, and a distance between the guide member 11 and the regulating blade 9 is adjusted to 5.5 mm. Here, the distance between the guide member 11 and the regulating blade 9 makes use of a distance between an intersection of the surface of the developing sleeve 8 to which a ridgeline of the guide member 11 extends and an intersection to which a ridgeline of the regulating blade 9 at the upstream side based on the rotational direction of the developing sleeve 8 extends. According to the examination of the inventors, the distance between the guide member 11 and the regulating blade can range from 3 mm to 10 mm.

Further, in the present embodiment, the guide member 11 is integrally formed with the partition 7 with which the developing container 2 is partitioned into the developing chamber 3 and the agitating chamber 4, and uses the same material as the developing container 2. In this way, by installing the guide member 11 at the upstream side of the regulating blade 9 based on the rotational direction of the developing sleeve 8, the developer fed from the first conveying screw 5 is also collected in a region surrounded by the regulating blade 9 and the guide member 11. This allows a coating amount on the developing sleeve 8 to be stabilized.

Figure 4:
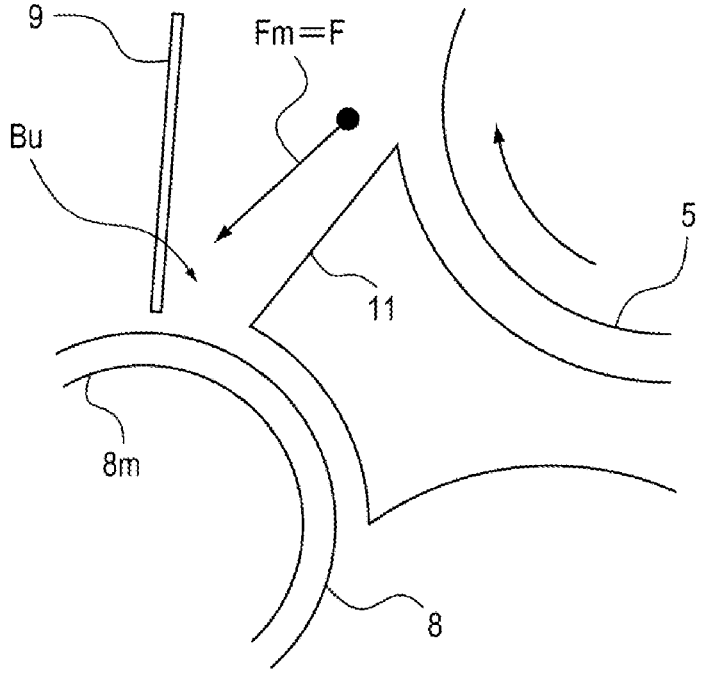
FIG. 4 is a cross-sectional view for describing a force (without a gravitational force) acting on a developer adjacent to a regulating blade of the first embodiment.
Figure 5:
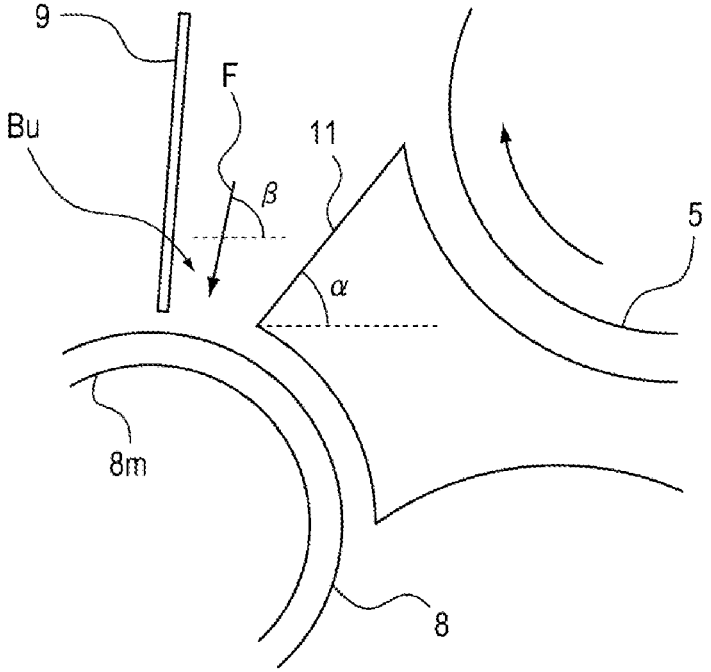
FIG. 5 is a cross-sectional view for describing α and β of the first embodiment.
Figure 6:
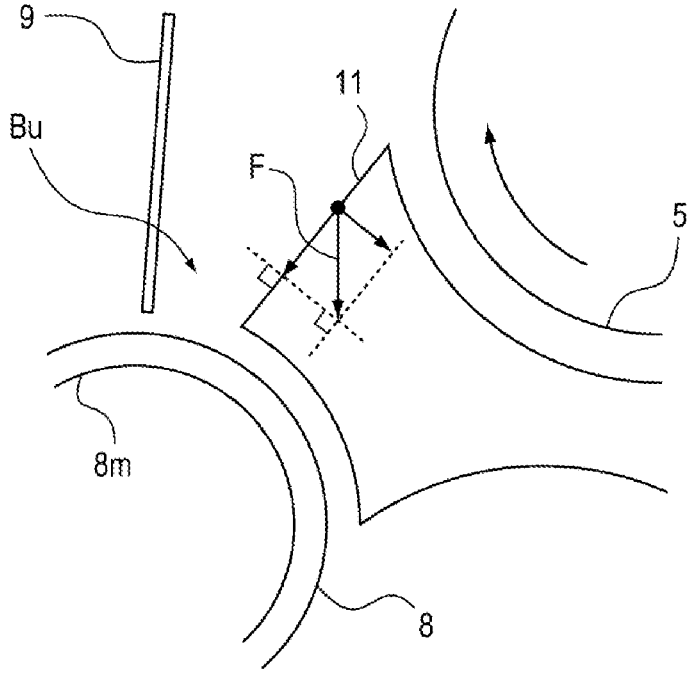
FIG. 6 is a cross-sectional view for describing the force acting on the developer adjacent to the regulating blade of the first embodiment.
Figure 7:
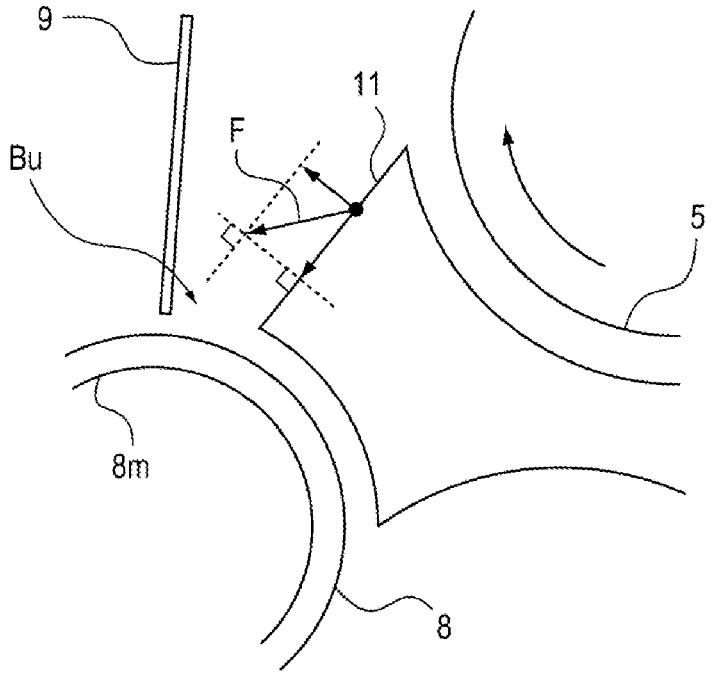
FIG. 7 is a cross-sectional view for describing the force acting on the developer adjacent to the regulating blade of the first embodiment.
Figure 8:
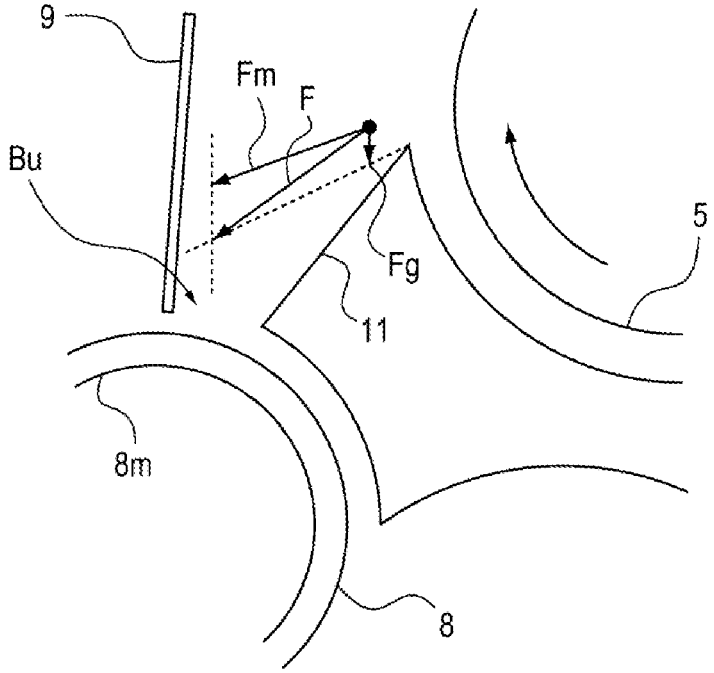
FIG. 8 is a cross-sectional view for describing the force acting on the developer adjacent to the regulating blade of the first embodiment.

<Guide Member (Backup Member)> Here, the guide member 11 that is a characteristic portion of the present embodiment will be described in greater detail using FIGS. 4 to 8. FIG. 4 is a cross-sectional view for describing a force (without a gravitational force) acting on the developer adjacent to the regulating blade of the first embodiment. FIG. 5 is a cross-sectional view for describing α and β of the first embodiment. FIG. 6 is a cross-sectional view for describing the force acting on the developer adjacent to the regulating blade of the first embodiment. FIG. 7 is a cross-sectional view for describing the force acting on the developer adjacent to the regulating blade of the first embodiment. FIG. 8 is a cross-sectional view for describing the force acting on the developer adjacent to the regulating blade of the first embodiment.

The developer from the first conveying screw 5 is backed up at the upstream side of the regulating blade 9 based on the rotational direction of the developing sleeve 8 by the guide member 11. As the guide member 11 is present, the developer is temporarily contained between the guide member 11 and the regulating blade 9. This portion in which the developer is temporarily contained is called a buffer portion Bu.

In the following description, a guide member-side angle which an inclination angle of a facing surface of the guide member 11 which is opposite to the regulating blade 9 forms with respect to the horizontal plane is set to α.

A magnet roller 8*m* is installed in the developing sleeve 8. For this reason, as illustrated in FIG. 4, the developer near the developing sleeve 8 typically receives an external force F made up of a magnetic force Fm. As illustrated in FIG. 5, when an angle which the external force F which any developer receives forms with respect to the horizontal plane is set to β, β of the external force F is uniquely decided at each point near the developing sleeve 8 by a magnetic force caused by a magnetic field which the magnet roller 8*m* produces and a gravitational force. That is, β is a function between coordinates and the magnet roller 8*m*.

As illustrated in FIG. 5, when β is greater than a on a surface of the guide member 11, the developer on the surface of the guide member 11 is pressed toward the guide member 11. Then, as illustrated in FIG. 6, the developer tends to stick to the surface of the guide member 11. In contrast, when β is smaller than α, as illustrated in FIG. 7, the developer is detached from the guide member 11, and it is difficult for the developer to stick to the surface of the guide member 11.

Even a case of including the gravitational force acting on the developer may be similarly taken into consideration. In this case, the developer near the developing sleeve 8 results in receiving the external force F that becomes a resultant force of the magnetic force Fm and the gravitational force Fg, as illustrated in FIG. 8. Hereinafter, the case of including the gravitational force will be described. Although an electrostatic force and a non-electrostatic adhesive force are present in reality, they are ignored because the aforementioned two forces are predominant.

Figure 9:
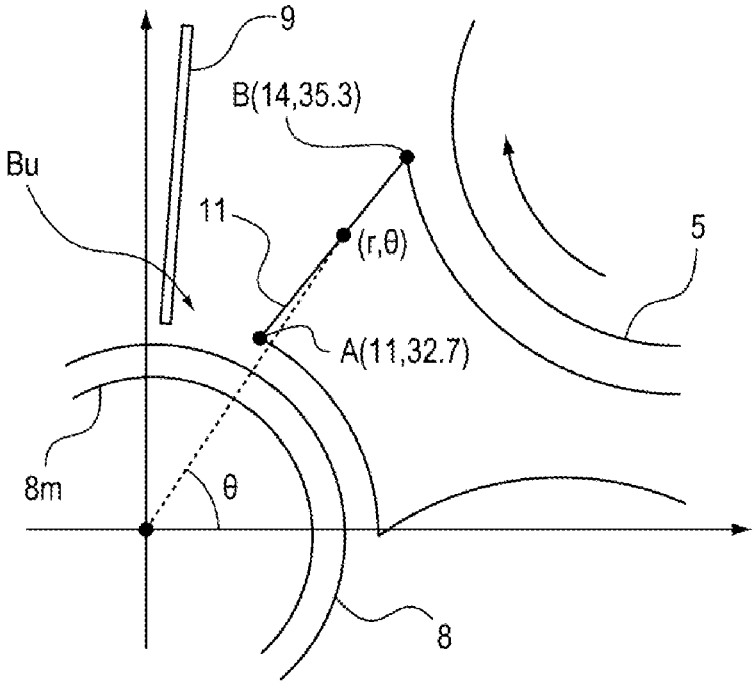
FIG. 9 is a cross-sectional view for describing a guide member of the first embodiment.
Figure 10:
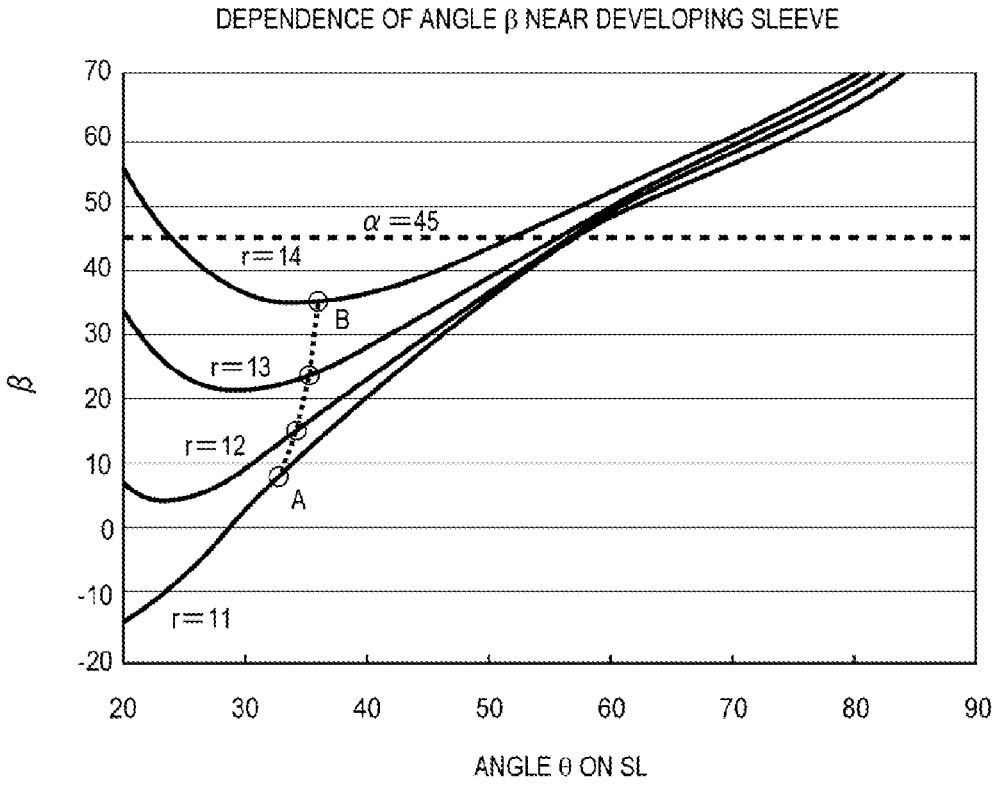
FIG. 10 is a graph depicting α and β adjacent to the regulating blade of the first embodiment.

FIG. 9 is a cross-sectional view for describing the guide member of the first embodiment. FIG. 10 is a graph depicting α and β adjacent to the regulating blade of the first embodiment. When polar coordinates are taken using the center of the developing sleeve as the origin O as in FIG. 9, β at each point (r, θ) is illustrated in FIG. 10.

Points A and B of FIG. 10 correspond to points A and B of FIG. 9. Then, when β on the surface of the guide member 11 is plotted from the point A of a lower end of the guide member 11 to the point B of an upper end of the guide member 11, the result becomes a segment AB connecting the points A and B of FIG. 10.

As illustrated in FIG. 10, β is increased in proportion to an increase in distance from the developing sleeve 8. This is because, with the increase in distance from the developing sleeve 8, the magnetic force Fm is reduced, whereas the gravitational force Fg is not changed, and thus the gravitational force Fg is relatively predominant, so that β is increased. Further, an angle which Fg forms with respect to the horizontal plane is 90°.

Further, if an angle on the developing sleeve 8 is θ (angle θ on SL in FIG. 10), as the angle increases, β is increased. This is because, as illustrated in FIG. 2, the same poles are disposed at angles on the developing sleeve θ=47° and θ=−68° respectively, whereas a different pole is disposed at θ=130°.

FIG. 10, β on the guide member 11 enters a range from 10° to 37°, and α on the surface of the guide member 11 is always smaller than 45°. For this reason, the developer receives a force in a direction away from the guide member 11 on the surface of the guide member 11. Thus, the phenomenon of the developer sticking to the surface of the guide member 11 can be reduced.

The configuration of the developing device 1 used in the present embodiment or the magnetic pole configuration of the magnet roller 8*m* is one method for meeting the condition of α>β. As long as the condition of α>β is met, the present invention is not limited to this configuration. For example, when the second magnetic pole N1 is changed at a downstream side based on the rotational direction of the developing sleeve, the magnetic pole moves away from the guide member 11 at the downstream side based on the rotational direction of the developing sleeve 8. For this reason, β on the guide member 11 is reduced accordingly. Here, there is no problem as long as the condition of α>β is met. Even in this case, the guide member is installed so as to meet the condition of α>β.

Further, in the present embodiment, the inclination angle of the guide member 11 is less than a slope of the regulating blade 9. The upper limit of α is configured so as not to be greater than the slope of the regulating blade 9. Thereby, a width between the regulating blade and the guide member is allowed to be increased, and the developer can be steadily fed to the upstream side of the regulating blade.

<Description of Magnet Roller Configuration and Magnetic Force> Here, a configuration of a developing magnet and a magnetic flux density and a magnetic force which the developing magnet produces will be described.

As illustrated in FIG. 2, the magnet roller 8*m* includes the developing pole N2 and the magnetic poles S1, S2, N1, and N3 that convey the developer. Among them, the first magnetic pole N3 and the second magnetic pole N1, which are the same poles, are disposed adjacent to each other and inside the developing container 2. Between the first magnetic pole N3 and the second magnetic pole N1, a repulsive magnetic field is formed, and a barrier is formed against the developer. For this reason, the developer carried on the developing sleeve 8 is detached at a position facing the agitating chamber 4.

The second magnetic pole N1 is disposed between the guide member 11 and the regulating blade 9. A repulsive region formed by the same poles of the first magnetic pole N3 and the second magnetic pole N1 is disposed so as to at least be an upstream side of the guide member 11. Further, the first magnetic pole N3 is disposed at a position of θ=−68°, and has a peak magnetic flux density of 21 mT and a half width of 30°. The second magnetic pole N1 is disposed at a position of θ=49°, and has a peak magnetic flux density of 43 mT and a half width of 40°. Further, the magnetic pole S1 is disposed at a position of θ=130°, and is adjusted so as to have a peak magnetic flux density of 115 mT and a half width of 50°.

The magnetic force described in the present embodiment may be calculated by a calculation method described in FIG. 11. FIG. 11 is a diagram illustrating numerical expressions used when obtaining the magnetic flux density of the first embodiment.

The magnetic force Fm acting on the magnetic carrier is given by Expression (1) of FIG. 11. Thus, if Br and Bθ are known from a relation of Expression (2) of FIG. 11, Fm can be obtained. Here, the magnetic flux densities Br and Bθ are those of vertical and tangent directions with respect to the surface of the developing sleeve at a certain point.

Further, between the first magnetic pole N3 and the second magnetic pole N1, both the vertical magnetic flux density Br and the horizontal magnetic flux density Bθ are regions equal to or less than 10 mT. Further, the magnetic force of a direction normal to an outer circumferential surface of the developing sleeve 8 includes a region (repulsive force) acting in a direction away from the developing sleeve 8. Further, the region of the repulsive force needs to be at the upstream side of the developing sleeve rather than the lower end of the guide member 11 as described above. Using a magnetic field measuring device "MS-9902" (trade name) manufactured by F.W. BELL, Inc. as a measuring device, Br can be measured by setting a distance between a probe, which is a member of the measuring device, and the surface of the developing sleeve 8 to about 100 μm.

Furthermore, Bθ can be obtained as follows. Using the measured magnetic flux density Br, a vector potential $A_z(R, \theta)$ at a measuring position of the magnetic flux density Br is obtained by Expression (3) of FIG. 11. Under a boundary condition of $A_z(R, \theta)$, $A_z$ (r, θ) is obtained by solving an equation of Expression (4) of FIG. 11. Then, Bθ can be obtained from Expression (5) of FIG. 11.

Br and Bθ measured and calculated in the aforementioned manner are applied to Expression (2) of FIG. 11, so that Fm can be derived.

<Test Results> Next, a test representing effects in the present embodiment will be described. An extent to which the developer sticks to the surface of the guide member 11 can be determined by an idle durability test (hereinafter simply referred to as "idleness") of the developing device 1. Since the idleness causes the first conveying screw 5, the second conveying screw 6, and the developing sleeve 8 to be driven in a state in which the developer enters the developing device 1, the developer in the developing device 1 circulates among the first conveying screw 5, the second conveying screw 6, and the developing sleeve. Next, processes thereof will be described.

(1) The developing device and the developer are left in an environment of 45° C. and 39% for 24 hours.

(2) A desired amount of the developer (320 g in the present embodiment) is filled into the developing device under the environment.

(3) After a desired coating amount on the developing sleeve is adjusted under the environment (30 mg/cm$^2$ in the present embodiment), the first conveying screw 5, the second conveying screw 6, and the developing sleeve 8 are driven at a desired circumferential velocity.

(4) After being driven for 10 hours, the regulating blade 9 is removed, and the guide member 11 is observed.

In the foregoing process (4), the extent to which the developer sticks to the surface of the guide member 11 is determined by the amount of developer sticking on the guide member 11. The determining method may be visual observation or mass of the sticking developer. However, in the present embodiment, the extent of sticking is determined by the visual observation and a sticking range. The sticking range refers to a sticking width and a sticking height.

Figure 12:
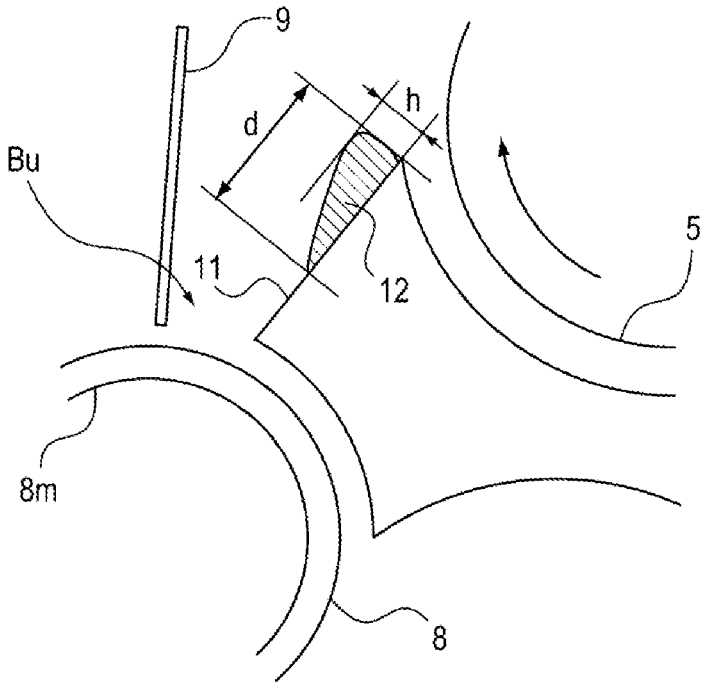
FIG. 12 is a cross-sectional view for describing a reference of the sticking developer of the first embodiment.

FIG. 12 is a cross-sectional view for describing a reference of the sticking developer of the first embodiment. As illustrated in FIG. 12, the sticking developer 12 sticking to the surface of the guide member 11 usually sticks mostly to a top portion of the guide member 11. Then, with the approach to the lower end of the guide member 11, a height of the sticking developer 12 is reduced. Accordingly, as illustrated in FIG. 12, as the sticking range, a sticking width d at which the sticking developer sticks from the top portion toward the lower end of the guide member 11, and the sticking height h from the surface of the guide member 11 are used.

When the reference of this sticking range is set, an extent of the sticking range of the sticking developer 12 on the surface of the guide member 11 after 10 hours of idleness when the angle α is changed becomes as in FIG. 13. FIG. 13 is a diagram illustrating test results of the first embodiment. In FIG. 13, symbols representing the extent of sticking have the following meanings. The extent of sticking "o" refers to a case in which the sticking developer is hardly observed. Further, the extent of sticking "Δ" refers to a case of 1 mm<h<3 mm at 1 mm<d<2 mm. The extent of sticking "x" refers to a case of 2 mm<d and 3 mm<h.

As illustrated in FIG. 13, it can be seen that, as the angle α is reduced, the extent to which the sticking developer sticks to the surface of the guide member 11 becomes worse. Particularly, it can be seen that, when α≤40°, a part (upper end) of the guide member 11 becomes α<β, and the extent to which the sticking developer sticks to the surface of the guide member 11 sharply becomes worse as well. On the other hand, when α>45°, α>β is always met on the surface of the guide member 11, and the extent to which the sticking developer sticks to the surface of the guide member 11 is also insignificant.

Figure 14:
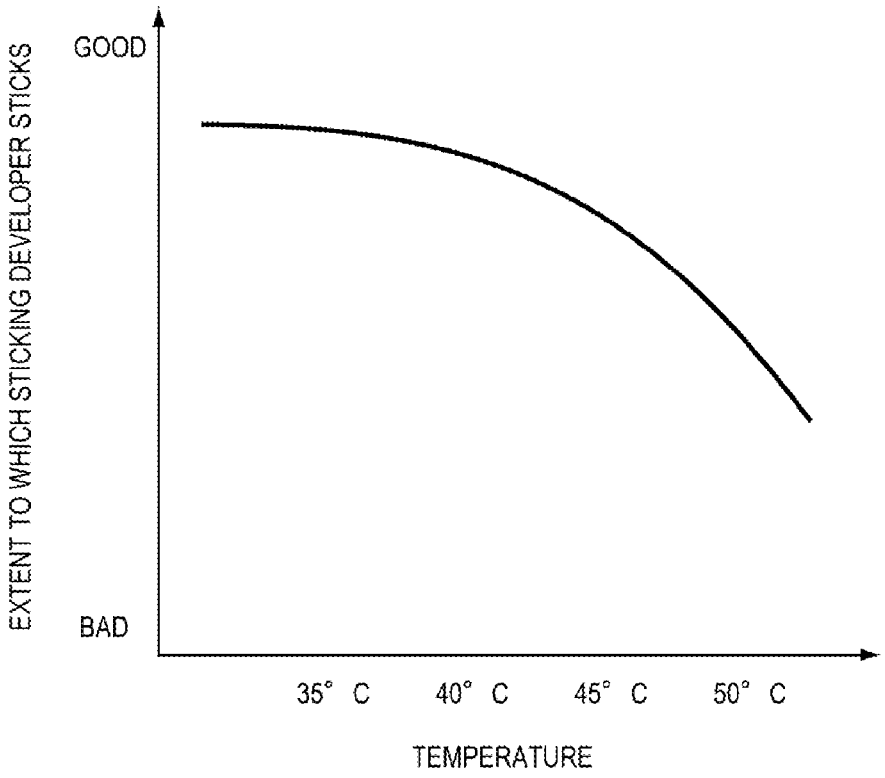
FIG. 14 is a conceptual view illustrating a relation between a temperature and an extent to which the sticking developer sticks in the first embodiment.

Further, as a temperature of the environment during the idleness becomes high, the extent to which the sticking developer sticks to the surface of the guide member 11 has a tendency to become worse (see FIG. 14). FIG. 14 is a conceptual view illustrating a relation between the temperature and the extent to which the sticking developer sticks in the first embodiment.

The characteristic illustrated in FIG. 14 is due to the fact that a higher temperature results in a softer toner resin, that the toner deterioration is accelerated by sliding of the developer, and that the adhesive force is increased. To respond to a market request for high-speed and energy saving of recent years, the toner used for the two-component developer transitions to a fixable design at a lower temperature. As a result, the toner itself has a tendency to be soft at room temperature, and the toner deterioration and the resulting developer sticking to the surface of the guide member are prone to take place more than before.

Second Embodiment

A second embodiment of the present invention is described. Since a basic configuration is the same as in the first embodiment, elements having a function and configuration that are substantially identical or equivalent to those of the first embodiment are indicated with the same reference numerals, and detailed description thereof is omitted herein. Hereinafter, only constituent portions unique to the present embodiment will be described in detail.

In the first embodiment, the angle α of the tip surface of the guide member 11 is set to be greater than the angle β of the external force F which the developer receives relative to the horizontal plane on the surface of the guide member 11, and the sticking of the developer to the surface of the guide member 11 is reduced.

Figure 15:
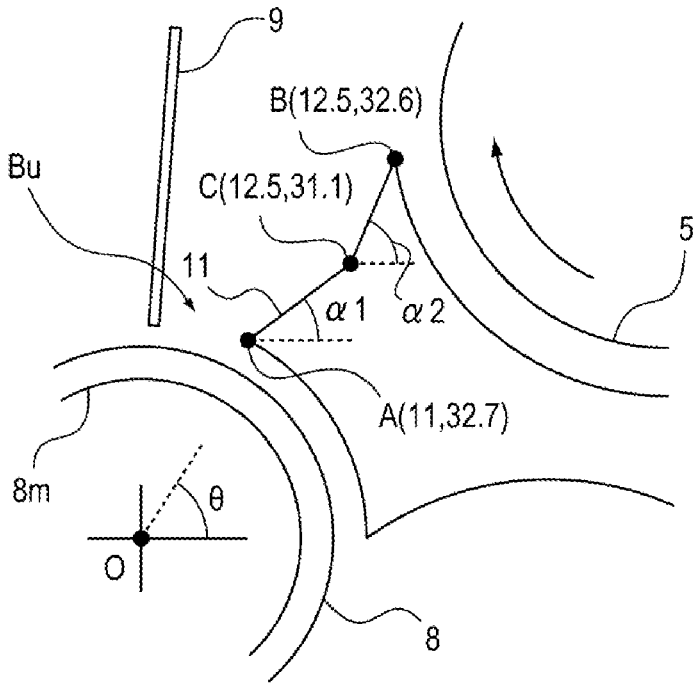
FIG. 15 is a cross-sectional view for describing a guide member of a second embodiment.

However, as described previously, β has a tendency to be gradually increased in proportion to the distance from the surface of the developing sleeve. For this reason, when the length of the guide member 11 is increased, it is conceived that it is difficult to meet the condition of α>β. The present embodiment is characterized in that the angle α of the surface of the guide member 11 relative to the horizontal plane is set so as to have at least two different angles while the condition of α>β is met. FIG. 15 is a cross-sectional view for describing the guide member of the second embodiment.

In the present embodiment, as illustrated in FIG. 15, an angle of a facing surface of the guide member 11 which is opposite to the regulating blade 9 is formed on a plurality of continuous planes having two angles α called an angle α1 and an angle α2. In polar coordinates using the center of a rotating shaft of the developing sleeve as the origin O, the angle α changes at a point C of r=12.5 mm and θ=31.1°. A point A and a point B are A(11, 32.7) and B(14, 32.6), and $\alpha 1=20°$ and $\alpha 2=45°$. With this configuration, even when the angle $\alpha$ is reduced to increase the length of the guide member 11, the condition of $\alpha>\beta$ can be met.

Figure 16:
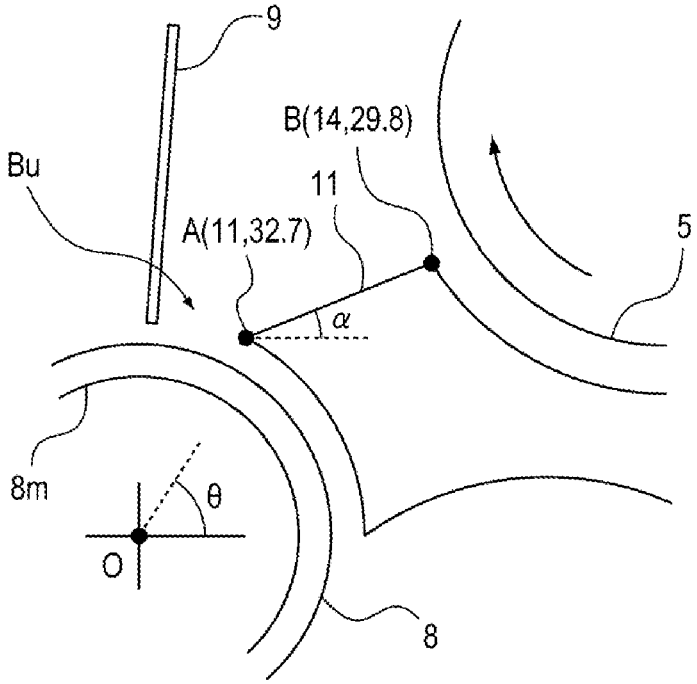
FIG. 16 is a cross-sectional view of a comparative example of the guide member used to describe the second embodiment.

FIG. 16 is a cross-sectional view of a comparative example of the guide member used to describe the second embodiment. In FIG. 16, a case in which there is only one angle $\alpha$, i.e. a case in which the guide member 11 is not bent halfway, is illustrated. In FIG. 16, the angle $\alpha$ is set to $\alpha=20°$.

Figure 17:
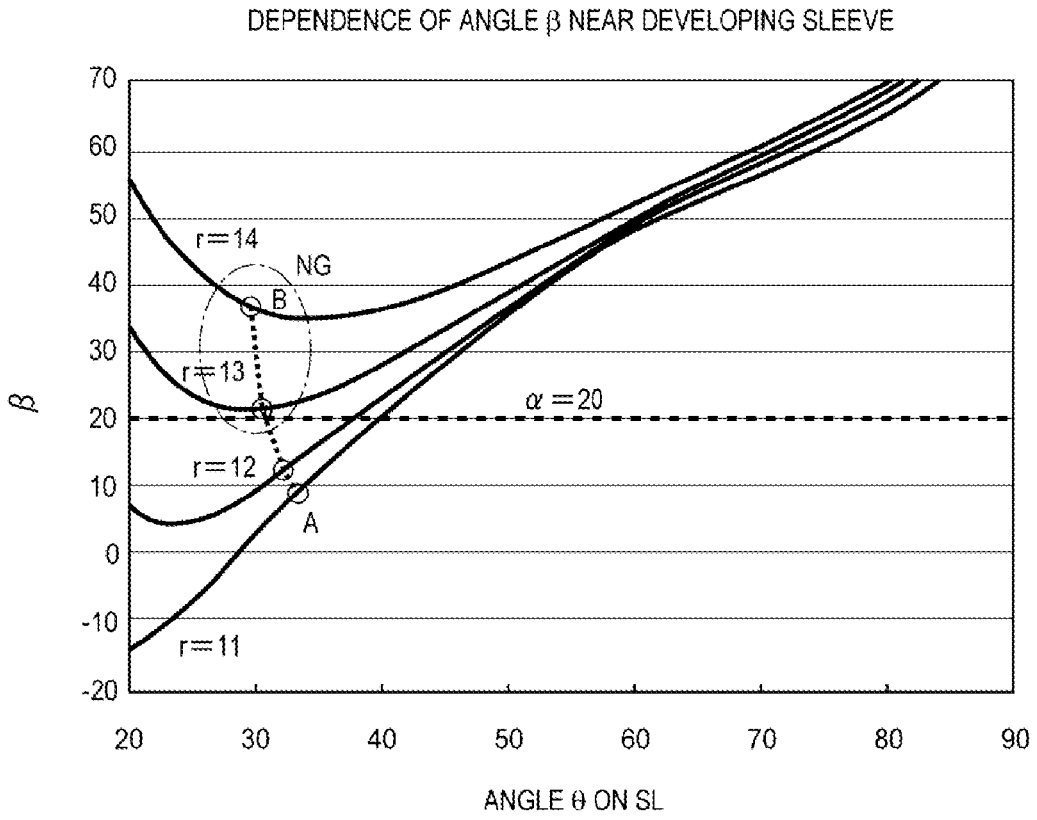
FIG. 17 is a view illustrating a relation between α and β adjacent to a regulating blade of the comparative example of the second embodiment.

When the polar coordinates using the center of the developing sleeve 8 as the origin are adopted, the angle $\beta$ at each point (r, $\theta$) in a case of the comparative example becomes as in FIG. 17. FIG. 17 is a view illustrating a relation between $\alpha$ and $\beta$ adjacent to a regulating blade of the comparative example of the second embodiment.

Similar to the first embodiment, points A and B in FIG. 17 correspond to points A and B of FIG. 16. That is, in FIG. 16, when $\beta$ on the surface of the guide member 11 is plotted from the point A of a lower end of the guide member 11 to the point B of an upper end of the guide member 11, the result becomes a segment AB connecting the points A and B of FIG. 17. Here, $\alpha<\beta$ is met at a region of 13 mm<r<14 mm, and the developer on the guide member 11 receives a force so as to be pressed against the guide member 11.

Figure 18:
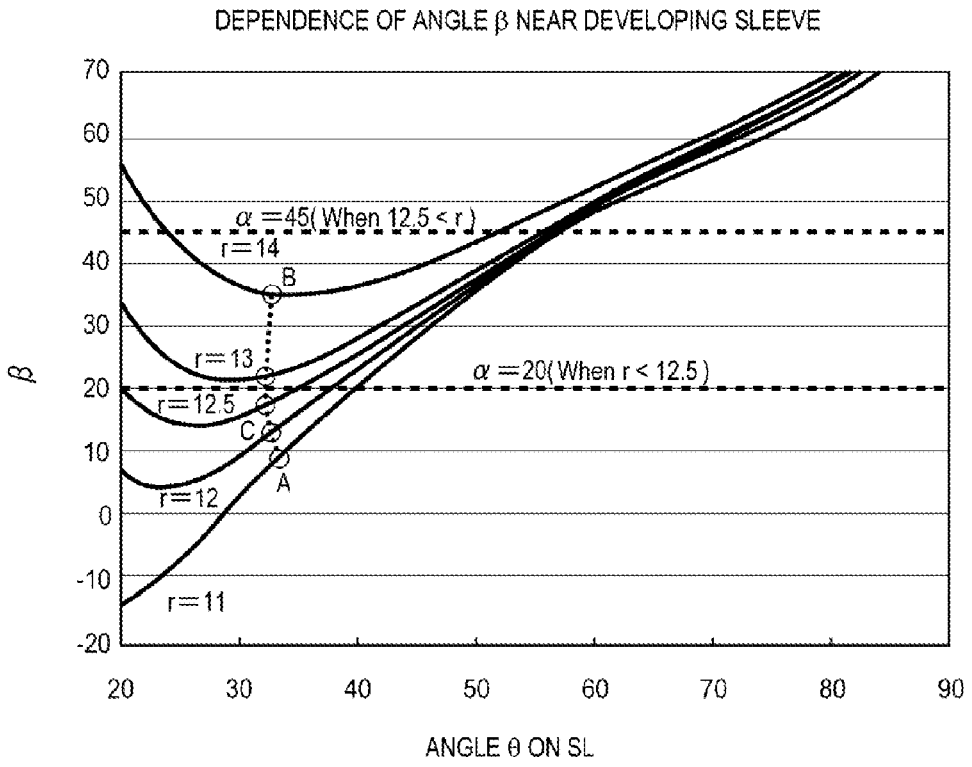
FIG. 18 is a graph depicting α and β adjacent to the regulating blade of the second embodiment.

On the other hand, a relation between $\alpha$ and $\beta$ for a configuration of the guide member 11 of the second embodiment will be described. FIG. 18 is a graph depicting $\alpha$ and $\beta$ adjacent to the regulating blade of the second embodiment. FIG. 18 depicts $\beta$ at each point (r, $\theta$) in the present embodiment. In FIG. 18, similar to the description up to now, a point A, a point B, and a point C correspond to the point A, the point B, and the point C in FIG. 15. Thus, when $\theta$ on the surface of the guide member 11 is plotted from the point A of the lower end of the guide member 11 to the point B of the upper end of the guide member 11 via the point C, the result becomes a segment ACB connecting the points A, B and C of FIG. 15.

In the present embodiment, a shape of the tip surface of the guide member 11 is formed so as to have the two angles $\alpha$ of $\alpha$1 and $\alpha$2. Thereby, as illustrated in FIG. 18, the condition of $\alpha>\beta$ can be met at all the points on the surface of the guide member 11.

<Test Results> FIG. 19 is a diagram illustrating test results of the second embodiment. In FIG. 19, an upper row is a result of an extent to which the developer sticks to the surface of the guide member in the case of the present embodiment (the case of FIG. 15), and a lower row is a result of the case of $\alpha=20°$ (the case of FIG. 16). A test method and a determination reference are similar to those represented in the first embodiment.

As illustrated in FIG. 19, it can be seen that, with the configuration of the present embodiment, the developer sticking to the guide member 11 can be further reduced.

Further, the configuration of the developing device 1 used in the present embodiment or the magnetic pole configuration of the magnet roller 8*m* is one method for meeting the condition of $\alpha>\beta$. As long as the condition of $\alpha>\beta$ is met, the present invention is not limited to this configuration.

Third Embodiment

A third embodiment of the present invention is described. Since a basic configuration is the same as in the first embodiment, elements having a function and configuration that are substantially identical or equivalent to those of the first embodiment are indicated with the same reference numerals, and detailed description thereof is omitted herein. Hereinafter, only constituent portions unique to the present embodiment will be described in detail.

Figure 20:
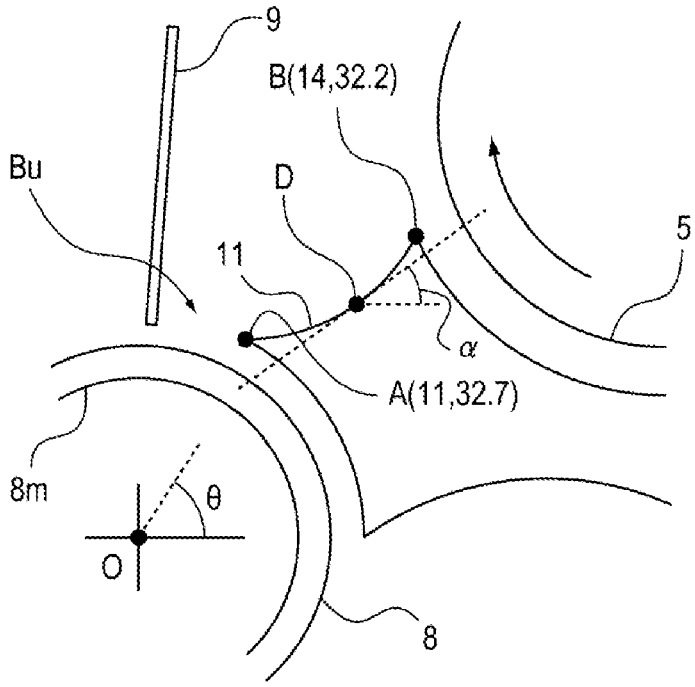
FIG. 20 is a cross-sectional view for describing a guide member of a third embodiment.

FIG. 20 is a cross-sectional view for describing a guide member of a third embodiment. As illustrated in FIG. 20, in the present embodiment, the surface of the guide member 11 is set to a curved surface. Thus, an angle $\alpha$ which a tangent at each point on the surface of the guide member 11 forms with respect to the horizontal plane at that point is set to an angle $\beta$ which an external force F, which is a resultant force of a magnetic force Fm and a gravitational force Fg which the developer receives at that point, forms with respect to the horizontal plane.

Here, the angle $\alpha$ is an angle which the tangent to the surface of the guide member 11 at each point on the surface of the guide member 11 forms with respect to the horizontal plane at that point, and differs at each point on the surface of the guide member 11. That is, the angle $\alpha$ at a certain point D is the tangent of the surface of the guide member at the point D (see a dot and dash line of FIG. 20).

Figure 21:
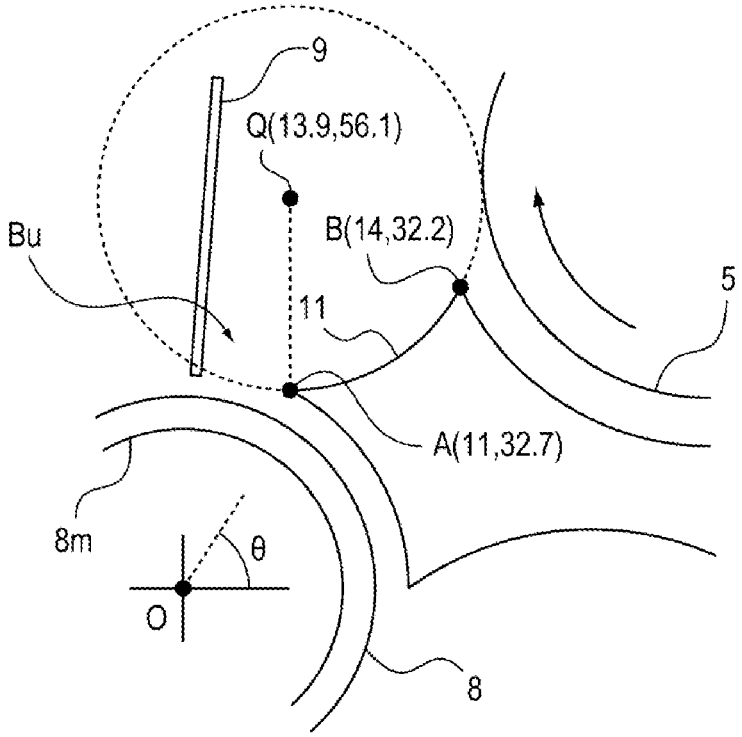
FIG. 21 is a cross-sectional view for describing a curvature of a tip of a guide member of a third embodiment.

FIG. 21 is a cross-sectional view for describing a curvature of a tip of a guide member of a third embodiment. In the present embodiment, as illustrated in FIG. 21, a point A of a lower end of the guide member 11 and a point B of an upper end of the guide member 11 are set to A(11, 32.7) and B(14, 32.2) in polar coordinates using the center of a developing sleeve 8 as the origin. Further, the point A is connected with the point B by an arc of a circle having a radius of R=5.8 mm, the center of which is set to a point Q(13.9, 56.1).

With this configuration, even when the angle $\alpha$ is reduced or when the guide member 11 is lengthened, the condition of $\alpha>\beta$ can be met.

Figure 22:
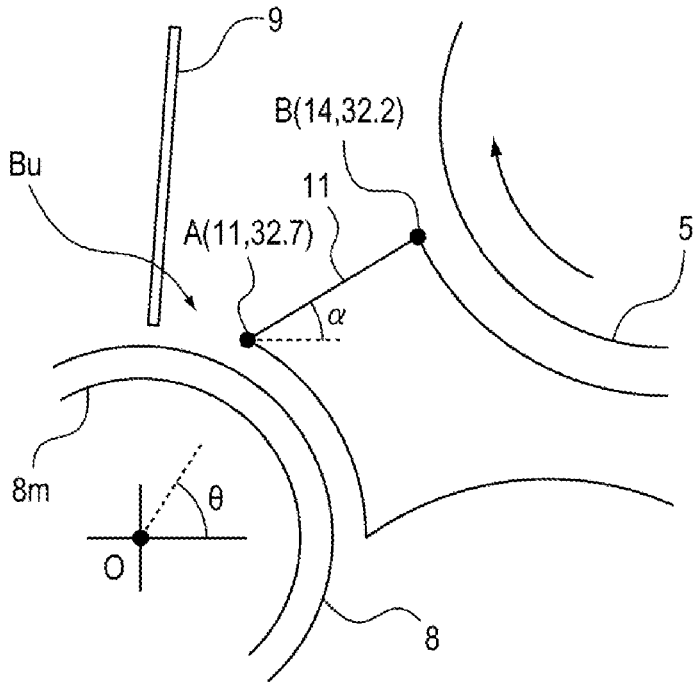
FIG. 22 is a cross-sectional view of a comparative example of the guide member used to describe the third embodiment.

Next, effects of the present embodiment will be described while being compared with a comparative example. FIG. 22 is a cross-sectional view of a comparative example of the guide member used to describe the third embodiment. In FIG. 22, a configuration in which the angle $\alpha$ is one, i.e. a configuration in which the guide member 11 is not bent halfway, is given. Here, the angle $\alpha$ of the comparative example is set to $\alpha=30°$.

Figure 23:
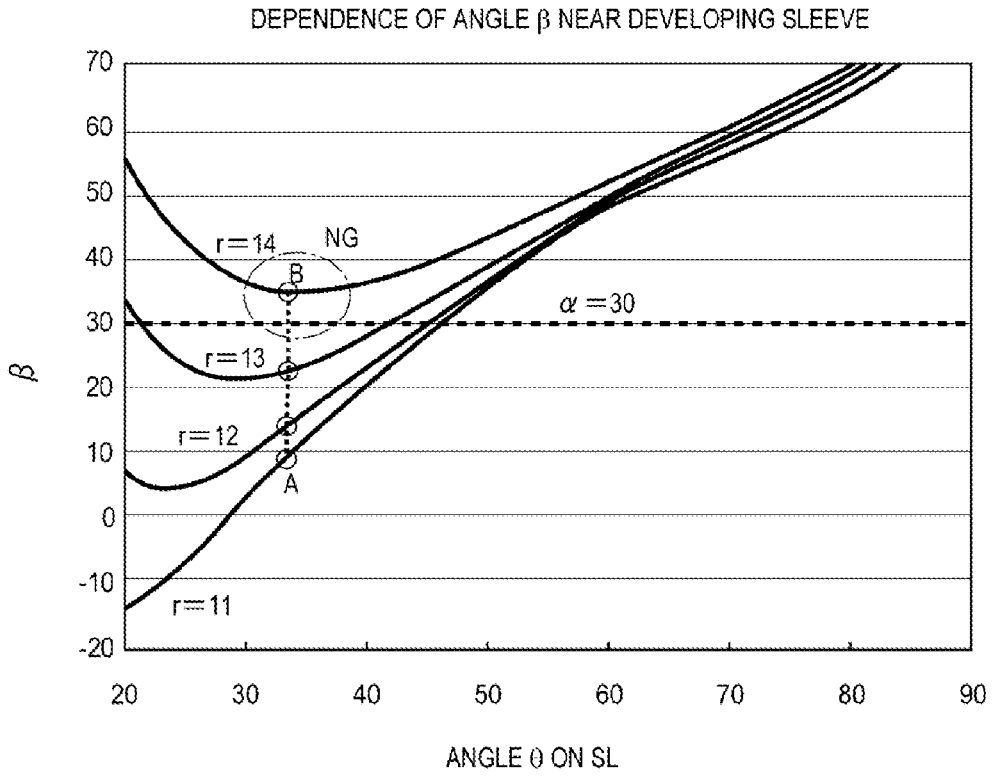
FIG. 23 is a graph depicting a relation between α and β adjacent to the regulating blade of a comparative example of the third embodiment.

FIG. 23 is a view illustrating a relation between $\alpha$ and $\beta$ adjacent to a regulating blade of the comparative example of the third embodiment. When polar coordinates using the center of the developing sleeve 8 as the origin are adopted, $\beta$ at each point (r, $\theta$) in the case of FIG. 22 becomes as in FIG. 23. Points A and B of FIG. 23 correspond to points A and B of FIG. 22. When $\beta$ on the surface of the guide member 11 is plotted from the point A of a lower end of the guide member 11 to the point B of an upper end of the guide member 11, the result becomes a segment AB connecting the point A and the point B of FIG. 23. Here, $\alpha<\beta$ is met at a region of 13 mm<r<14 mm, and it can be seen that the developer on the guide member 11 receives a force so as to be pressed against the guide member 11.

Figure 24:
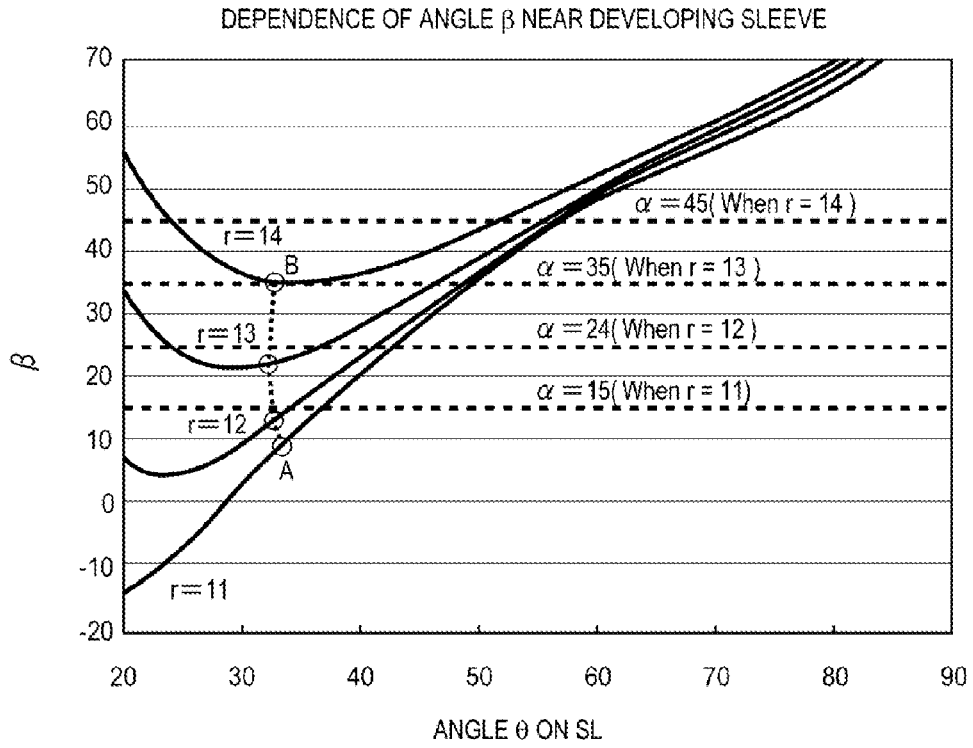
FIG. 24 is a graph illustrating α and β adjacent to the regulating blade of the third embodiment.

FIG. 24 is a graph depicting $\alpha$ and $\beta$ adjacent to the regulating blade of the third embodiment. $\beta$ at each point (r, $\theta$) in the present embodiment is depicted in FIG. 24. Similar to the aforementioned description, points A and B of FIG. 24 correspond to the points A and B of FIG. 21 illustrating the configuration of the guide member 11 of the present embodiment. Thus, when $\beta$ on the surface of the guide member 11 is plotted from the point A of a lower end of the guide member 11 of FIG. 21 to the point B of an upper end thereof, the result becomes a segment AB connecting the point A and the point B of FIG. 24.

In FIG. 24, $\alpha$ at four points of r=11 mm, 12 mm, 13 mm, and 14 mm on the surface of the guide member is illustrated in the present embodiment, the angle α differs at each point on the surface of the guide member 11.

It can be seen from FIG. 24 that, in the present embodiment, since the surface of the guide member 11 is the curved surface, although β on the surface of the guide member 11 is increased, α is further increased at that point. It can be seen from this that the condition of α>β is met.

Figure 25:
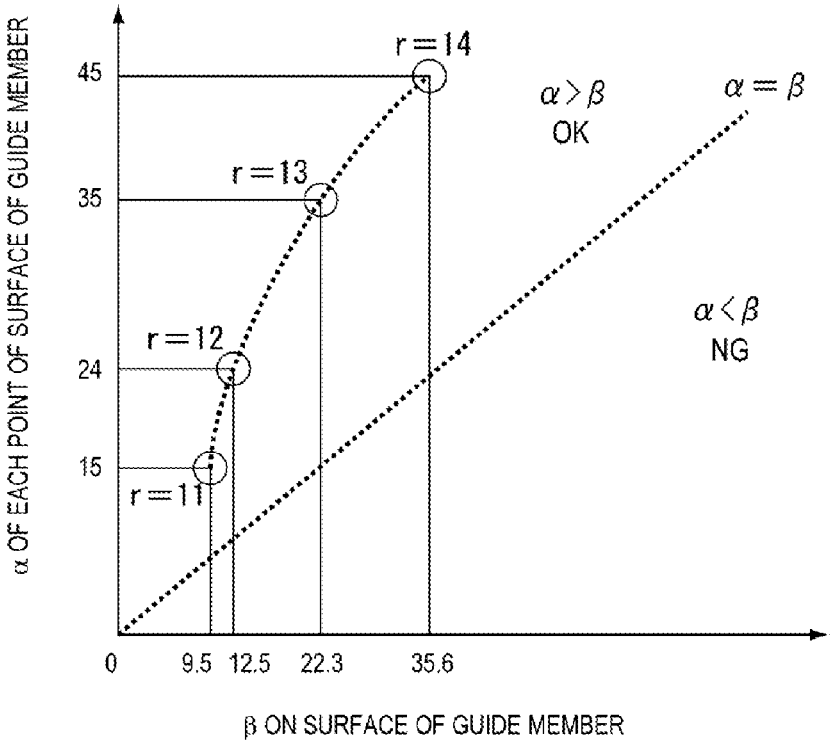
FIG. 25 is a graph depicting a relation between α and β adjacent to the regulating blade of the third embodiment.
Figure 27:
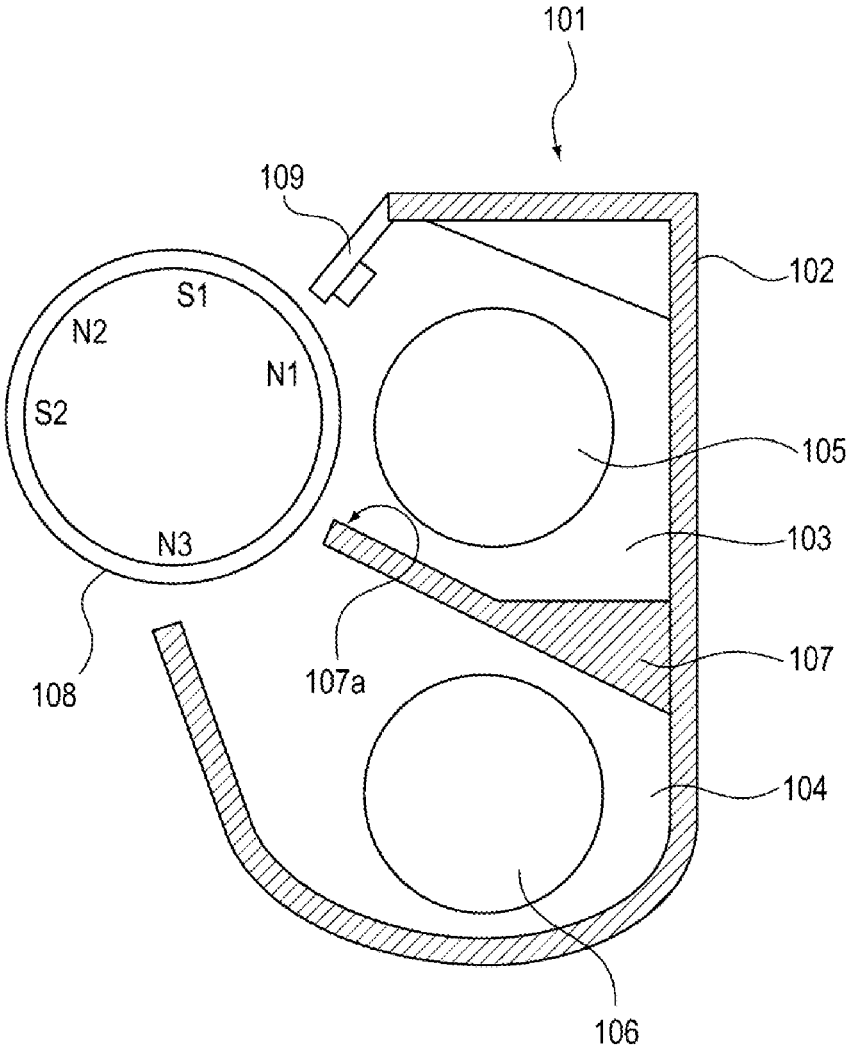
FIG. 27 PRIOR ART
FIG. 27 is a cross-sectional view for describing a conventional developing device.

FIG. 25 is a graph illustrating a relation between α and β adjacent to the regulating blade of the third embodiment. In FIG. 25, α and β on the surface of the guide member in the present embodiment are given to a longitudinal axis and a transverse axis, respectively. A broken line in FIG. 25 is a line of α=β. For this reason, a region at which α is greater than the broken line becomes a region (OK zone) in which the developer does not tend to stick, whereas a region at which α is smaller than the broken line becomes a region (NG zone) in which the developer tends to stick.

As illustrated in FIG. 25, with the configuration of the present embodiment, it can be seen that all the regions between r=11 mm and r=14 mm fall into the OK zone.

FIG. 26 is a diagram illustrating test results of the third embodiment. In FIG. 26, with regard to the extent to which the developer sticks to the surface of the guide member, the case of the present embodiment (the case of FIG. 21) and the case of α=30° (the case of FIG. 22) are compared. A test method and a determination reference are similar to those illustrated in the first embodiment. As in FIG. 26, in the case of the present embodiment, an amount of the developer sticking to the guide member 11 is reduced.

Further, the configuration of the developing device used in the present embodiment or the magnetic pole configuration of the magnet illustrates one method for meeting the condition of α>β. As long as the condition of α>β is met, the present invention is not limited to this configuration.

According to the above configuration, the attachment of the developer to the surface of the guide member can be suppressed, and the coat unsteadiness caused by poor feeding of the developer can be suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-102578, filed Apr. 27, 2012, which is hereby incorporated by reference herein in its entirety.

What is claimed is:

1. A developing device comprising:

a developer carrier which carries a developer containing a toner and a carrier;

a magnet installed inside the developer carrier and including a plurality of magnetic poles in a rotational direction of the developer carrier;

a developing chamber which feeds the developer to the developer carrier;

a conveying member which conveys the developer of the developing chamber;

a regulating member which regulates an amount of the developer coated on the developer carrier; and a guide portion which guides the developer to the developer carrier, wherein the guide portion forms a part of the developing chamber between the regulating member and the conveying member and forms a buffer portion that temporarily contains the developer fed from the developing chamber between the regulating member and the guide portion, and wherein, the guide portion has a facing surface opposing the developer carrier along a front surface of the developer carrier and a guiding surface which guides the developer from an upper edge of the guide portion to a downstream side of the facing surface in a rotational direction of the developer carrier, and the plurality of magnetic poles are disposed so that a magnetic direction effecting the carrier in the developer on the guiding surface is set in a direction to leave the guiding surface in a range from an upper portion toward a lower portion of the guiding surface.

2. The developing device according to claim 1, wherein the guide portion has an inclination angle equal to or less than a slope of the regulating member.

3. The developing device according to claim 1, wherein the guide portion has a planar facing surface that is opposite to the regulating member.

4. The developing device according to claim 1, wherein the guide portion is configured so that a slope to a horizontal plane is reduced toward a developer conveying direction downstream.

5. The developing device according to claim 1, wherein the guiding surface is a curved surface.

6. The developing device according to claim 1, further comprising a developing container including an agitating chamber installed below the developing chamber and agitating the developer recovered from the developer carrier using a developer agitating member disposed there inside and a partition that partitions the developing container into the developing chamber and the agitating chamber, and the guide portion is integrally formed with the partition.

7. The developing device according to claim 1, wherein at least one of the magnetic poles is installed more upstream than the regulating member and more downstream than the guide portion in relation to a rotational direction of the developer carrier.

8. The developing device according to claim 1, wherein a conveying path of the developer formed between the guiding surface and a face opposing the guiding surface is formed narrower downstream of the developer conveying direction.

* * * * *